US006503623B1

(12) United States Patent
Oue et al.

(10) Patent No.: US 6,503,623 B1
(45) Date of Patent: Jan. 7, 2003

(54) YARN COMPRISING POLYTRIMETHYLENE TEREPHTHALATE

(75) Inventors: Kazuto Oue, Takatsuki (JP); Hiroshi Yamazaki, Ibaraki (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/869,278

(22) PCT Filed: Dec. 27, 1999

(86) PCT No.: PCT/JP99/07361

§ 371 (c)(1),
(2), (4) Date: Jun. 26, 2001

(87) PCT Pub. No.: WO00/39374

PCT Pub. Date: Jul. 6, 2000

(30) Foreign Application Priority Data

Dec. 28, 1998 (JP) ..... 10/372717
May 26, 1999 (JP) ..... 11/145832

(51) Int. Cl.[7] ..... D01F 6/00
(52) U.S. Cl. ..... 428/364; 428/395
(58) Field of Search ..... 428/364, 395; 84/297 S; 473/524, 522

(56) References Cited

U.S. PATENT DOCUMENTS 6,242,091 B1 * 6/2000 Howell et al. ..... 428/357
6,284,370 B1 * 9/2001 Fujimoto et al. ..... 428/395
6,333,106 B2 * 12/2001 Howell et al. ..... 428/364

FOREIGN PATENT DOCUMENTS

EP 0 547 553 A1 6/1993
JP 58104216 A 6/1983
JP 5-262862 10/1993
JP WO 99/27168 * 6/1999
JP 11229276 A 8/1999
WO WO96/00808 1/1996
WO WO99/11845 3/1999

* cited by examiner

*Primary Examiner*—N. Edwards
(74) *Attorney, Agent, or Firm*—Finnegan, Henderson, Farabow, Garrett & Dunner, L.L.P.

(57) ABSTRACT

The present invention provides a yarn composed of polytrimethylene terephthalate fibers, particularly polytrimethylene terephthalate multifilamentary fibers having a single-fiber size in a range from 1 to 56 dtex, which are collected together to have a total size in a range from 2000 to 22000 dtex.

Further, the present invention provides a racket string composed of polytrimethylene terephthalate multifilamentary fibers having a single-fiber size in a range from 1 to 56 dtex, which are collected together to have a total size in a range from 7000 to 22000 dtex, and a musical instrumental string composed of polytrimethylene terephthalate multifilamentary fibers having a single-fiber size in a range from 1 to 56 dtex, which are collected together to have a total size in a range from 2000 to 14000 dtex.

The yarn according to the present invention is high in strength, elastic recovery and stress-retaining ratio as well as excellent in water resistance, softness and homogeneity of yarn properties. The racket string according to the present invention can be set across a racket frame, for example, for tennis or other, games under a high tension, whereby high resilience is obtainable when the string is set, and maintained for a long time. Also, this racket string is excellent in impact resistance, durability and water resistant. The musical instrumental string is stable in tuning over time and with a change in humidity as well as excellent in tunability.

7 Claims, No Drawings

YARN COMPRISING POLYTRIMETHYLENE TEREPHTHALATE

TECHNICAL FIELD

The present invention relates to a yarn composed of polytrimethylene terephthalate fibers, particularly to a yarn composed of polytrimethylene terephthalate multifilamentary fibers having a single-fiber size in a range from 1 to 56 dtex, which are collected together to have a total size in a range from 2000 to 22000 dtex and a racket string, and a musical instrumental string, formed of such a yarn.

BACKGROUND ART

Polytrimethylene terephthalate fiber is an epoch-making fiber having merits similar to those of nylon fiber, such as a soft touch derived from a low elastic modulus (modulus of elasticity) thereof and a superior elastic recovery (modulus of elastic recovery), as well as merits similar to those of polyethylene terephthalate fiber, such as a wash-and-wear property, a dimensional stability and a resistance to yellowing. However, since trimethylene glycol, which is one of the raw materials of polytrimethylene terephthalate fiber, was expensive, this fiber has hardly been commercially produced up to now. A technology for industrially producing trimethylene glycol at a low cost has been developed, and now the commercialization of the polytrimethlene terephthalate fiber has been proceeded in the clothing and carpet fields in which the above-mentioned properties are suitably usable.

However, the polytrimethylene terephthalate fiber has hardly been applied to fields other than clothing until now.

Also, there is no case wherein the polytrimethylene terephthalate multifilamentary fibers are collected together to form a yarn and used without being woven or knit into a fabric, or applied as commercial products to a field other than the clothing. Therefore, there is no yarn consisting of polytrimethylene terephthalate multifilamentary fibers having a single-fiber size in a range from 1 to 56 dtex, which are collected together to form a unitary yarn having a total size in a range from 2000 to 22000 dtex.

In the prior art, polytrimethylene terephthalate multifilamentary fibers having a single-fiber size in a range from 0.00011 to 11 dtex, which are collected to form a yarn having a total size in a range from 5.6 to 1100 dtex, are known as disclosed in WO99/11845 filed by the applicant of the present application. However, the fibers disclosed in this publication are used for forming a fabric article after being woven or knit, and there is no description in that polytrimethylene terephthalate fibers having a single-fiber size in a range from 1 to 56 dtex are collected together to form a unitary yarn having a total size in a range from 2000 to 22000 dtex, which yarn is used, as it is or after the fibers are adhered together or coated with resin, for a racket string or a musical instrumental string.

A multifilamentary yarn according to the present invention is high in strength, elastic recovery and stress-retaining ratio and excellent in water resistance, softness and yarn-homogeneity in comparison with the prior art yarn formed by collecting filamentary fibers having a single-fiber size exceeding 56 dtex to have a total size in a range from 2000 to 22000 dtex, and is suitably used in a field wherein the yarn is used as it is or after the fibers are adhered together and/or coated with resin, particularly for a racket string or a music instrumental string.

There are two types of string for tennis or badminton rackets in the prior art; one being prepared from synthetic fibers, for example, of nylon or others and the other being prepared from a natural source such as the gut of cattle or sheep, or an animal tendon of, for example, a whale; which are suitably twisted and coated with resin. Although it is said that such a natural origin string is favorable in resilience, ball-control, impact feeling and ball-holding feeling because it still has a suitable elongation even though it has stretchingly been set across a frame under a high tension, the string of a natural origin is problematic in durability and resistance to water as well as its expensiveness.

Contrary to this, the synthetic string is excellent in durability and resistance to water, but if it is used for a long period in a tensed state which is favorable for obtaining good resilience, the string is liable to gradually extend, which causes a tension loss, lowers the resilience and deteriorates the impact feeling and the ball-holding feeling. As a result, the re-setting of the string is often required even before the string is broken. The string of nylon fibers has a high standard regain and tends to easily elongate in a wet state, whereby if the string gets wet, the string tension largely lowers to deteriorate the impact resilience, impact feeling and ball-holding feeling. Since a string of high elastic modulus fibers such as aramid fibers has a high strength and a low elongation at break, it changes less in tension with time even though the string has been stretchingly set across a frame at a high tension, but is problematic in that the resilience is too low to absorb the impact because the string is not stretchable upon ball impact.

There is a description in Japanese Unexamined Patent Publication No. 5-262862 that a 657 denier size polytrimethylene terephthalate monofilamentary fiber is very suitably used as a racket string because of its lower Young's modulus and larger elongation at break in comparison with those of nylon fiber. Also there is another description therein that the multiple lengths of polytrimethylene terephthalate monofilament will be bonded together using a polymer coating to form a unitary yarn used as a racket string. Neither physical properties nor performances of the actual string, however, are disclosed therein. Also, there is no description of a total size of the collected multifilamentary fibers and the string. The disclosed monofilamentary fiber is as fine as 657 deniers, which has a suitable resilience at an initial stage when a plurality thereof are collected together and used as a racket string, but has a drawback in that the resilience falls with time. Further, the impact feeling, the ball-controllability and the impact resistance are poor.

Under the circumstances, there has been a demand for a high-durability racket string capable of being set across a racket frame under a high tension and having a favorable resilience lasting for a long time as well as being excellent in impact resistance and ball-controllability.

Regarding a string for a musical instrument, a metallic string, a nylon string and a natural origin string are mainly used in the prior art. The nylon string is liable to slacken with time after it has stretchingly been set on the instrument body and tuned and thus needs frequent tuning and therefore a considerable time is required to put in tuning. Also, the nylon string is not always satisfactory because it is often slackened or tensed to vary in tuning in accordance with the environmental humidity due to the hygroscopic property thereof. On the other hand, the natural source string has stability in tuning over time under a low humidity in comparison with the nylon string, but has a problem in that it lacks uniformity in size of yarn because of its natural source which may cause the breakage of the string due to the concentration of stress to a limited part. Also, the natural source string is expensive.

Under the circumstances, there has been a demand for a musical instrumental string excellent in tunability and in stability in tuning over time and with a change in humidity.

Although Japanese Unexamined Patent Publication No. 5-262862 discloses that a polytrimethylene terephthalate monofilamentary yarn is used as a yarn for a guitar, it does not indicate a concrete method for manufacturing the same or the effects thereof.

DISCLOSURE OF THE INVENTION

An object of the present invention is to provide a yarn composed of polytrimethylene terephthalate fibers, particularly polytrimethylene terephthalate multifilamentary fibers having a single-fiber size in a range from 1 to 56 dtex, which are collected together to have a total size in a range from 2000 to 22000 dtex. This yarn is high in strength, elastic recovery and stress-retaining ratio and excellent in water resistance, softness and homogeneity of yarn properties.

Another object of the present invention is to provide a racket string and a musical instrumental string formed of the above-mentioned yarn.

A further object of the present invention is to provide a racket string capable of being stretchingly set under a high tension across a racket frame to have a high resilience lasting for a long time and excellent in impact resistance, durability and resistance to water.

A furthermore object of the present invention is to provide a musical instrumental string excellent in tunability and in stability in tuning over time and with a change in humidity.

The present inventors have found that the problems in the prior art could be solved to achieve the above-mentioned objects of the present invention by using a yarn composed of polytrimethylene terephthalate multifilamentary fibers having a single-fiber size in a range from 1 to 56 dtex, which are collected together to have a total size in a range from 2000 to 22000 dtex. Thus, the present invention has completed.

That is, according to the present invention, a yarn is provided which is composed of polytrimethylene terephthalate fibers, particularly polytrimethylene terephthalate multifilamentary fibers having a single-fiber size in a range from 1 to 56 dtex, which are collected together to have a total size in a range from 2000 to 22000 dtex.

Also, a racket string is provided, which is composed of polytrimethylene terephthalate multifilamentary fibers having a single-fiber size in a range from 1 to 56 dtex, which are collected together to have a total size in a range from 7000 to 22000 dtex.

Further, a musical instrumental string is provided, which is composed of polytrimethylene terephthalate multifilamentary fibers having a single-fiber size in a range from 1 to 56 dtex, which are collected together to have a total size in a range from 2000 to 14000 dtex.

In the present invention, the polytrimethylene terephthalate type fiber is a polyester fiber containing trimethylene terephthalate as a main repeated unit wherein the trimethylene terephthalate unit is contained at a ratio of approximately 50 mol % or more, preferably 70 mol % or more, more preferably 80 mol % or more, further more preferably 90 mol % or more. Accordingly, this fiber includes polytrimethylene terephthalate containing, as a third component, another acidic component and/or glycolic component of a total amount of less than approximately 50 mol %, preferably less than 30 mol %, more preferably less than 20 mol %, further more preferably less than 10 mol %.

The polytrimethylene terephthalate is synthesized by bonding terephthalic acid or a functional derivative thereof with trimethylene glycol or functional derivative thereof in the presence of catalyst under a suitable reactive condition. In this synthesis process, one kind or more of a third component may be added to be copolymerized polyester, or after individually preparing other polyester than polytrimethylene terephthalate such as polyethylene terephthalate; nylon; and polytrimethylene terephthalate, they may be blended together or spun to be a composite fiber (a sheath-core type fiber or a side-by-side type fiber).

The third component to be added includes aliphatic dicarbonic acid (oxalic acid, adipic acid or the like), cycloaliphatic dicarbonic acid (cyclohexane dicarbonic acid or the like), aromatic dicarbonic acid (isophthalic acid, sodium sulfoisophthalic acid or the like), aliphatic glycol, (ethylene glycol, 1, 2-propylene glycol, tetramethylene glycol, or the like), cycloaliphatic glycol(cyclohexane dimethanol or the like), aliphatic glycol containing aromatic group (1, 4-bis(β-hydoxyethoxy)benzene or the like), polyether glycol(polyethylene glycol, polypropylene glycol or the like), aliphatic oxycarbonic acid(ω-oxycapronic acid or the like) or aromatic oxycarbonic acid(p-oxybenzoic acid or the like). Also, compounds having one or three or more ester-forming functional groups (benzoic acid, glycerin or the like) may be used provided the polymer is maintained substantially in a linear range.

The polytrimethylene terephthalate may contain a delustering agent such as titanium dioxide, a stabilizing agent such as phosphoric acid, a bluing agent such as cobalt acetate, an ultraviolet absorbing agent such as derivative of hydroxybenzophenone, a crystal neucleator, such as talc, a lubricant such as aerozil, an antioxidant such as derivative of hindered phenol, a flame retardant, an antistatic agent, a pigment, a fluorescent whitener, an infrared absorbing agent, and an antifoaming agent.

The polytrimethylene terephthalate fiber used in the present invention may be spun by either a normal method wherein after an undrawn yarn has been obtained at a takeup speed of approximately 1500 m/min, it is drawn at a draw ratio in a range from approximately 2 to 3.5 times, a spin-draw method wherein a spinning process is directly combined with a drawing process, a spin-takeup method wherein a yarn spun from a spinning machine is directly taken up at a high speed of 5000 m/min or more, or a method wherein an undrawn yarn is once cooled through a water bath and then drawn.

The polytrimethylene terephthalate multifilamentary fibers having a single-fiber size in a range from 1 to 56 dtex thus obtained are collected together to form a yarn of a total size in a range from 2000 to 22000 dtex, which is a polytrimethylene terephthalate multifilamentary yarn according to the present invention.

In the present invention, a single-fiber size of the polytrimethylene terephthalate multifilamentary yarn is in a range from 1 to 56 dtex, preferably from 5.6 to 44 dtex. Within this range, the yarn obtained is high in strength, resilience and stress-retaining ratio and excellent in softness and homogeneity. If the single-fiber size is less than 1 dtex, filament breakage often occurs during the spinning and/or drawing, and the strength and the abrasion resistance of the yarn become lower. Contrarily, if the size of fiber exceeds 56 dtex, the homogeneity of the yarn is deteriorated because the cooling of the respective filaments is insufficient to cause the fusion-bonding thereof. Further, if the single-fiber size exceeds 56 dtex, the cooling becomes insufficient to result in heterogeneity of crystalline orientation in the fiber cross-section because the polytrimethylene terephthalate has a high crystallization speed. That is, in the fiber cross-section, the crystalline orientation degree is higher in the outer area but is lower in the central area, whereby the strength and the resilience of the fiber become lower, and the stress-retaining ratio of the yarn is lowered.

In the present invention, a total size of the basic yarn prior to being collected is preferably in a range from 56 to 560 dtex. Physical properties of the polytrimethylene terephthalate multifilamentary basic yarn prior to being collected are such that the tensile strength is 2.6 cN (centi-Newton)/dtex or more, preferably 3.3 cN or more, and the elongation at break is preferably 25% or more, more preferably in a range from 30 to 60%, furthermore preferably from 40 to 50%. If the elongation at break exceeds 60%, the elastic recovery is liable to lower. The elastic modulus is preferably in a range from 18 to 36 cN/dtex, more preferably from 20 to 30 cN/dtex, and the elastic recovery at 20% elongation is preferably in a range from 60 to 99%, more preferably from 70 to 99%. Also, a U% may be used for estimating a quality of the multifilamentary basic yarn prior to be collected. The U% is a parameter for representing a lengthwise homogeneity of the fiber, and is preferably 3.0% or less, more preferably 2.5% or less.

The yarn of the present invention is one formed by collecting a plurality of the above-mentioned multifilamentary basic yarns to have a total size in a range from 2000 to 22000 dtex. If the total size is less than 2000 dtex, the tensile strength and the resistance to wear of the yarn is too low to be used as a racket string or a musical instrumental string. Contrarily, if it exceeds 22000 dtex, a total diameter becomes too large to collect the basic yarns together as a unitary yarn form, which is particularly unsuitable for a racket string or a musical instrumental string. By collecting a plurality of the multifimamentary basic yarns, each having a total size in a range from 56 to 560 dtex, together to form a unitary yarn having a total size in a range from 2000 to 22000 dtex, it is possible to easily obtain a yarn cross-section closer to a genuine circle and a more homogeneous physical property throughout the yarn cross-section. Particularly, the racket string or musical instrumental string requires such a genuine circular cross-section as well as homogeneous physical property throughout the cross-section, whereby the yarn according to the present invention is suitably used for this purpose.

The physical property of the yarn thus collected is such that the tensile strength is in a range from 50 to 1000 N (Newton), preferably from 60 to 800 N, the elongation at break is in a range from 25% to 80%, preferably from 35 to 60%, more preferably from 40 to 50%, the elastic recovery at 20% elongation is in a range from 60 to 99%, preferably from 70 to 99%, more preferably from 75 to 99%, and the stress-retaining ratio at 49.0 N is 60% or more, preferably 70% or more, more preferably 75% or more.

Any method may be adopted for collecting a plurality of the multifilamentary basic yarns, such as collecting the multifilamentary basic yarns in a non-twisted state; collecting the multifilamentary basic yarns in an interlaced manner; collecting several to several tens of interlaced multifilamentary basic yarns and twisting them together; collecting a plurality of the multifilamentary basic yarns, each prepared in a non-twisted state, and twisting them together; or collecting several to several tens of the twisted multifilamentary basic yarns and further twisting them. The resultant yarn may be a non-twist yarn, a single-twist yarn, a plied yarn, a koma-twist yarn and a corkscrew twist yarn. Also, while there is no limitation in the number of twists per unit length, usually it is 1500 T/m or less, preferably in a range from 10 to 1000 T/m, more preferably from 20 to 500 T/m. If the number of twists is less than 10 T/m, the collectivity of the multifilamentary basic yarns is insufficient whereby the handling thereof becomes difficult. Contrarily, if it exceeds 1500 T/m, the yarn strength lowers to a great extent. Twisting machines used for this purpose include an Italian twister, an uptwister, a double twister, a covering machine, a doubling/twisting machine, a ring type twister and a twister for composite yarns.

The yarn according to the present invention may be suitably applicable not only to the racket string and the musical instrumental string, but also to a rope, a cord or a sewing thread for industrial use.

According to the present invention, the collected or non-collected polytrimethylene multifilamentary basic yarns are favorably treated with heat while being maintained at a constant length or in a stretched state before or during the treatment with an adhesive to facilitate the crystalline orientation of the fiber so that the elastic recovery and the stress-retaining ratio are improved to minimize the lowering of tension with time when used as a racket string or a musical instrumental string. While no limitation exists in the heat treatment temperature, it is usually carried out at a temperature in a range from 150 to 200° C., preferably from 160 to 180° C. If the temperature is lower than 150° C., the improvement in crystalline orientation is insufficient, while if exceeding 200° C., the yarn strength is liable to lower. Usually the treatment time is preferably in a range from 20 seconds to 2 minutes. The stretching ratio during the heat treatment while a test piece is maintained at a constant length or in a stretched state is in a range from 0 to 10%, preferably from 0 to 5%. If the heat treatment is carried out in a relaxed state, the stress-retaining ratio is liable to lower. According to this constant-length or stretched heat treatment, it is possible to lower the elongation at break of the fiber to a value in a range from 30 to 60%, preferably from 40 to 50% even if the elongation at break of the non-treated fiber exceeds 60%.

The present inventors have diligently studied a racket string, and found that the drawbacks of the prior art string could be solved by using as a racket string a yarn composed of polytrimethylene terephthalate multifilamentary basic yarns having a single-fiber size in a range from 1 to 56 dtex to have a total size in a range from 7000 to 22000 dtex, which yarn is high in resilience and impact resistance and excellent in durability, resulting in the present invention.

The racket string of the present invention will be described below in more detail.

Since the racket string according the present invention is high in elastic recovery, in comparison with the prior art one, even in a tensed state, in other words, in a state when the string is stretchingly set under a high tension across a racket frame at an elongation in a range from 5 to 25%, the initial stress-retaining ratio is also high and the variation of the string tension with time becomes less. The initial resilience is high and is maintained for a long time. The string provides a proper elongation and a favorable elastic recovery when a ball is struck, and thus is excellent in impact resistance, ball-holding feeling and ball-control.

The polytrimethylene terephthalate multifilamentary yarn according to the present invention has the tensile strength of 230 N or more, preferably 300 N or more. If the tensile strength is less than 230 N, that of the resultant string becomes too low. If a yarn having a total size exceeding 22000 dtex is used for improving such a low tensile strength, a diameter of the string excessively increases to deteriorate the resilience, impact feeling, ball-control and impact resistance. Also, the elongation at break is 25% or more, preferably in a range from 40 to 50%. If the elongation at break is less than 25%, the elongation of the string becomes insufficient after the string has stretchingly been set across the racket to deteriorate the impact resistance and the ball-holding feeling. Contrarily, if it exceeds 50%, the elastic recovery lowers to slacken the string, resulting in the reduction of tension to worsen the resilience. The elastic recovery at 20% elongation is in a range from 60 to 99%, preferably from 70 to 99%. The stress-retaining ratio at a stress of 49.0 N is 70% or more, particularly preferably 75% or more. The stress-retaining ratio at a stress of 205.9 N is 70%, particularly preferably 75% or more. If the elastic recovery is less than 60% or the stress-retaining ratio is less than 70%, the string tension lowers to a large extent whereby the resilience of the string is liable to lower with time after stretchingly being set across the racket. Also, the residual elongation of the yarn is in a range from 1.5 to 8%, preferably from 2.0 to 6.0% because the impact resistance of the string is improved.

In the present invention, a single-fiber size of the multifilamentary yarn is in a range from 1 to 56 dtex, preferably from 5.6 to 44 dtex. If it is less than 1 dtex, the abrasion resistance becomes low to shorten the life of the string. If exceeding 56 dtex, the fiber diameter becomes excessively large to disturb the uniformity of crystalline orientation, whereby the outer area of the fiber has a higher crystalline orientation but the central area has a lower crystalline orientation to deteriorate the strength as well as the elastic recovery. As a result, the elastic recovery of the string becomes lower to deteriorate the stress-retaining ratio and particularly the resilience. A total size is in a range from 7000 to 22000 dtex. If it is less than 7000 dtex, there are problems in that the tensile strength of the string becomes insufficient for stretchingly setting the same across the racket under a high tension in a range from 50 to 60 pounds and the string is liable to break due to the impact of ball. If it exceeds 22000 dtex, a diameter of the resultant string becomes excessively large to deteriorate the resilience as well as the impact resistance. Thus, the ball-holding feeling and the ball-controllability of the string are also deteriorated.

The yarn of the present invention having a total-fiber size in a range from 7000 to 22000 dtex is composed of polytrimethylene telephthalate multifilamentary yarns having a single-fiber size in a range from 1 to 56 dtex.

According to the present invention, a ratio in weight of the yarn of the present invention to the final string is preferably 50% or more, more preferably 70% or more, further preferably 90% or more. If less than 50%, the object of the present invention is not sufficiently achievable.

There are many methods for manufacturing a string using polytrimethylene terephthalate multifilamentary fibers, including, for example, a method wherein 13 to 400 lengths of the multifilamentary basic yarn having a total size in a range from 56 to 560 dtex are collected to form a unitary yarn having a total size in a range from 7000 to 22000 dtex, then adhered to each other with an adhesive and coated with polymer to result in a string; a method wherein multifilamentary basic yarns, each having a total size in a range from 56 to 560 dtex, are collected together in advance to have a total size in a range from 1000 to 6000, 4 to 22 lengths of which are further collected to have a total size in a range from 7000 to 22000 dtex, adhered together with an adhesive and finally coated with polymer to obtain a string; a method wherein 1 to 20 lengths of the polytrimethylene terephthalate monofilamentary yarn, each having a size in a range from 660 to 11000 dtex, are used as a core component, and the multifilamentary yarn having a single-fiber size in a range from 1 to 56 dtex is used as a sheath component to result in a final yarn having a total size in a range from 7000 to 22000 dtex; a method wherein 30 to 10000 lengths of the polytrimethylene terephthalate multifilamentary basic yarn, each having a single-fiber size in a range from 1 to 56 dtex are collected together to form a core component, and a synthetic yarn having a single-fiber size in a range from 10 to 60 dtex other than the polytrimethylene terephthalate one is used as a sheath component to result in a final yarn; and a method wherein the multifilamentary basic yarns are used both for core and sheath components in which a size of the core component is larger or smaller than that of the sheath component.

Multifilamentary fibers in the yarn for a racket string thus obtained are adhered to each other with an adhesive and coated with polymer or others. That is, for the purpose of filling interstices between filaments and coating the outer surface of the yarn, the adhesive or the polymer is applied to the yarn by the immersion or the coating so that an adhesive layer or a coated layer is provided, which serves for preventing the racket string from being worn and further enhancing the durability. More preferably, another layer of fluorine resin or silicon resin is formed on the coated layer.

The above-mentioned methods are not limitative in the present invention. In summary, the string should be constituted by a yarn composed of polytrimethylene terephthalate multifilamentary basic yarns having a single-fiber size in a range from 1 to 56 dtex, which are collected together to have a total size in a range from 7000 to 22000 dtex, which yarn is used as a core component or a sheath component or all of the string. The string may contain other synthetic fibers, if desired, as the core component or the sheath component or part of the yarn, provided the mixing ratio thereof is 50% or less, preferably 30% or less by weight. Such fibers may be incorporated in the yarn, for example, by twisting.

As an adhesive used in the present invention, urethane type resin, epoxy type resin, acrylic type resin, silicone type resin, polyvinyl alcohol type resin, polyamide type resin, polyester type resin, polycarbonate type resin, acrylate type ultraviolet-curing type resin or others is advantageously used. Of them, in view of the adhesivity to polytrimethylene terephthalate fiber, softness and resistance to bending, urethane type resin and acrylic type resin are preferably used. The polymer coating the outermost layer of the string is used as a molten form or a solution form dissolved in a suitable solvent. The polymer includes polyamide type resin, urethan type resin, polyester type resin, fluorine type resin or silicon type resin.

According to the present invention, the multifilamentary yarn is twisted at 1000 T/m or less, preferably in a range from 20 to 500 T/m so that the collectivity is maintained. However, the twisting is not always indispensable provided the collectivity is maintained during the post treatment. If it exceeds 1000 T/m, the strength and the elastic modulus of the yarn are liable to lower.

The string according to the present invention is suitable for rackets for tennis, badminton or squash.

The present inventors have diligently studied a musical instrumental string, and found that the drawbacks of the prior art string could be solved by using, as a musical instrumental string, a yarn composed of polytrimethylene terephthalate multifilamentary yarns having a single-fiber size in a range from 1 to 56 dtex to have a total size in a range from 2000 to 14000 dtex, which string is stable in tuning over time and with a change in humidity and is easily tunable, resulting in the present invention.

The musical instrumental string of the present invention will be described below in more detail.

Since the musical instrumental string according the present invention is high in elastic recovery in comparison with the prior art one, it is stable in tuning over time after it has been set on a musical instrument and is easily tunable to attain a stability in tuning in a relatively short time. Also, the string does not slacken or become tense even if the humidity varies, and can maintain a stability in tuning.

The polytrimethylene terephthalate multifilamentary yarn according to the present invention has the tensile strength of 52 N or more, preferably 60 N or more. If the tensile strength is less than 52 N, that of the resultant string would become too low to be used in practice. Also, in such a case, since a lower tension must be adopted for setting the string on the musical instrument, the playing may be disturbed due to the looseness of the string tension. The elongation at break is preferably in a range from 25 to 60%, more preferably from 40 to 50%. If the elongation at break is less than 25%, breakage of the string may occur at a relatively early stage due to the repetition of the tuning after the string has been set, to result in the shortage of duration of life thereof. Contrarily, if exceeding 60%, the elastic recovery becomes low to increase the variation in tuning. The elastic modulus is in a range from 18 to 36 cN/dtex, preferably from 20 to 36 cN/dtex, and the elastic recovery at 20% elongation is in a range from 60 to 99%, preferably from 70 to 99%. If the elastic modulus is less than 18 cN/dtex and the elastic recovery is less than 60%, the tunability is deteriorated because the variation in tuning is so large that a long time is required for obtaining a stability in tuning. The stress-retaining ratio at a stress of 49.0 N is 70% or more, preferably 75% or more. If it is less than 70%, the variation in tuning is liable to occur over time after the string has been set on the musical instrument and tuned.

In the present invention, a single-fiber size of the multifilamentary yarn is in a range from 1 to 56 dtex, preferably from 5.6 to 44 dtex. If it is less than 1 dtex, the resistance to wear of the string becomes low, which may cause the filament breakage during the playing to vary in tuning. Also, the life of the string becomes shorter. If it exceeds 56 dtex, the fiber diameter becomes excessively large to disturb the uniformity of crystalline orientation, whereby the outer area of the fiber has a higher crystalline orientation but the central area has a lower crystalline orientation to lower the strength as well as the elastic recovery. As a result, the string is liable to slacken with time when used on the musical instrument, not only to largely vary in tuning but also to deteriorate the tunability; i.e., to require a long time for tuning the same to a stability in tuning. A yarn having a total size in a range from 2000 to 14000 dtex is used. If it is less than 2000 dtex, the tensile strength of the string becomes insufficient for practical use, and breakage of the string may occur during tuning or playing. Contrarily, if it exceeds 14000 dtex, a diameter of the resultant string becomes excessively large to disturb the playing.

There are many methods for manufacturing the musical instrumental string, including, for example, a method wherein a plurality of multifilamentary yarns are collected or twisted together to form a unitary yarn which is used as it is as a string; a method wherein individual filaments in the collected and twisted multifilamentary yarn are bonded together with a resin to form a string; a method wherein the collected, twisted and resin-bonded multifilamentary yarn is impregnated or coated as a whole with a synthetic polymer to form a string having improved resistance to wear and durability; a method wherein the yarn coated with the synthetic polymer is further coated with fluorine resin or silicone resin to form a string having a water repellent effect, and a method wherein a piano wire of steel, copper, aluminum, stainless steel, platinum or silver having a diameter in a range from 0.08 to 1.0 mm is twined around the collected, twisted or resin-bonded multifilamentary yarn to form a string. The above-mentioned methods are not limitative in the present invention. In summary, the string should be constituted by a yarn composed of polytrimethylene terephthalate multifilamentary basic yarns having a single-fiber size in a range from 1 to 56 dtex, which are collected together to have a total size in a range from 2000 to 14000 dtex. The string may contain other synthetic fibers if desired, provided the mixing ratio thereof is 30% or less, preferably 20% or less by weight. Such fibers may be incorporated in the yarn, for example, by twisting or covering.

As an adhesive used in the present invention, urethane type resin, epoxy type resin, isocyanate type resin, acrylic type resin, silicone type resin, polyvinyl alcohol type resin, polyamide type resin, polyester type resin, polycarbonate type resin, acrylate type ultraviolet-curing type resin or others is advantageously used. Of them, in view of the adhesivity to polytrimethylene terephthalate fiber, softness and resistance to bending, urethane type resin and acrylic type resin are preferably used.

The polymer for coating the outermost layer of the string is used in a molten form or a solution form dissolved in a suitable solvent. The polymer includes polyamide type resin, urethan type resin, polyester type resin, fluorine type resin or silicone type resin.

According to the present invention, the multifilamentary yarn is twisted at 1000 T/m or less, preferably in a range from 20 to 500 T/m so that the collectivity is maintained. However, the twisting is not always indispensable provided the collectivity is maintained during the post treatment. If exceeding 1000 T/m, the strength and the elastic modulus of the yarn are liable to lower.

The musical instrumental string according to the present invention is suitable for guitar, ukulele, harp, violin, viola, cembalo, contrabass, lute, samisen or koto. Further, it may be used as a tail gut for a violin or a viola.

BEST MODES FOR CARRYING OUT THE INVENTION

The present invention will be described in more detail below with reference to the preferred embodiments, wherein parts are represented by weight.

Methods for estimating the embodiments are as follows:

(1) Estimation of Strength and Elongation

A test piece of 20 cm long was stretched at a rate of 20 cm/min by using TENSILON produced by TOYO BALDWIN Co. Ltd, and a tensile strength (cN/dtex), a elongation (%) and an initial elastic modulus (cN/dtex) were measured.

(2) Measurement of Elastic Modulus

The elastic modulus was measured in accordance with JIS-L-1013.

(3) Estimation of Elastic Recovery

A test piece loaded with an initial load of 0.0109 cN/dtex was stretched at a rate of 20%/min and, when the elongation reaches 20%, shrunk in the reverse direction at the same rate to develop a stress-strain curve. A residual elongation L was determined from the curve as a point where the stress is lowered to the initial load of 0.0109 cN/dtex during the shrinkage, whereby the elastic modulus at 20% elongation was calculated by the following equation:

$$\text{Elastic modulus at 20\% elongation}=(20-L)/20\times100\ (\%)$$

(4) Measurement of U%

U% was measured by using USTER TESTER 3 produced by Zellweger Uster.

(5) Estimation of Stress-retaining Ratio

Test pieces of 20 cm long were loaded with 49.0 N and 205.9 N by stretching the same at a rate of 20 cm/min by using TENSILON produced by TOYO BALDWIN Co. Ltd, and a stress was measured after leaving the test pieces for 24 hours, from which the stress-retaining ratio was calculated. The higher the stress-retaining ratio, the less the reduction of the string tension with time, which means that the change of resilience and the change in tuning with time is minimized.

(6) Measurement of Residual Elongation

A test piece of 20 cm long was loaded with 205.9 N by stretching the same at a rate of 20 cm/min by using TENSILON produced by TOYO BALDWIN Co. Ltd, and an elongation A1 was measured after leaving the test piece for one hour. Then the test piece was further stretched until the stress reaches 255.0 N, at which an elongation A2 was measured. The residual elongation was calculated by the equation (A2−A1).

The lower the residual elongation, the poorer the impact resistance, because the racket string is hardly stretched upon the ball impingement.

(7) Feeling Test

Tennis rackets were prepared by stretchingly setting strings across a frame in the vertical and transverse directions under a tension of 223 N (50 pounds). A questionnaire was conducted on thirty armature players in a tennis school about the resilience and the impact resistance after actually striking a regulation tennis ball with the rackets. This questionnaire was conducted twice, one day and twenty days after the string has been set, wherein ◎: 24 persons or more in 30 replied "good".

○: 18 to 23 persons in 30 replied "good".

Δ: 15 to 17 persons in 30 replied "good".

x: 14 persons or less in 30 replied "good".

(8) Estimation of Durability

Five of the above-mentioned rackets were used for testing the durability, wherein regulation tennis balls are sequentially projected from a tennis ball machine to the racket 50 cm away therefrom at a projection speed of 100 km/h and at 15 cycles/min, until the string is broken. The average of the number of balls projected on the five rackets was determined.

(9) Estimation of Variation in Tuning

A string was set on a classic guitar (produced by KAWAI GAKKI K.K.) and tuned in a released state to the respective musical intervals (frequencies) by using a tuning meter (produced by Korg; Model DTR-1) and a microphone (produced by Sony; F-V600P). After being tuned, the frequency variation with time was measured, while maintaining the string as it is, to estimate the variation in tuning. The set musical interval in the released state, the ambient temperature during the tuning and the estimation of the variation with time were as follows:

(Condition 1)

After being tuned to a musical interval of 587 Hz (re) in the ambience of 20° C.×65%RH and left for 12 hours in the ambience of 20° C.×85%, the frequency was measured.

(Condition 2)

After being tuned to a musical interval of 784 Hz (so) in the ambience of 20° C.×65%RH and left for 24 hours in the same ambience, the frequency was measured.

(Condition 3)

After being tuned to a musical interval of 986 Hz (si) in the ambience of 20° C.×65%RH and left for 24 hours in the same ambience, the frequency was measured.

(10) Estimation of Tunability

Strings were set on a classic guitar (available from KAWAI GAKKI K.K.) and tuned so that a second one of the strings is to be 986 Hz (si), a third one is to be 784 Hz (so) and a fourth one is to be 587 Hz (re). Thereafter, the guitar was played with fingers every day for one hour until the stability in tuning is attained within half a musical interval between before and after the playing. The number of such days were measured. In this regard, since the second day, the play was conducted after the tuning.

◎: the stability in tuning was attained on the first day.

○: the stability in tuning was attained by the third day.

Δ: the stability in tuning was attained by the seventh day.

x: the stability in tuning was attained after the seventh day.

(11) Estimation of String Durability

In the same manner as in the estimation of tunability, the tuning and the playing with fingers were repeated on the manufactured strings until the same were broken, wherein ◎: no breakage occurred over 15 days.

○: breakage occurred within 14 days.

Δ: breakage occurred within 7 days.

x : breakage occurred within 3 days.

(12) Estimation of Ease of Play

Strings manufactured according to the present invention and those available by market (YAMAHA; S-10) were set on classic guitars (produced by KAWAI GAKKI K.K.), which were then actually played by thirty armature players. A questionnaire was conducted on them about the ease of play of the manufactured strings, wherein ◎: 24 persons or more in 30 replied "good".

○: 18 to 23 persons in 30 replied "good".

Δ: 15 to 17 persons in 30 replied "good".

x: 14 persons or less in 30 replied "good".

EXAMPLE 1

An undrawn yarn was obtained from polytrimethylene terephthalate chips having ηsp/c of 1.1 at a spinning temperature of 265° C. and a spinning speed of 1200 m/min, and drawn at a hot roll temperature of 60° C. and a hot plate temperature of 140° C., a draw ratio of 2.5 times and a drawing speed of 800 m/min to result in a drawn yarn of 235 dtex/35 f. Physical properties of the drawn yarn were a strength of 3.7 cN/dtex, an elongation of 35%, an elastic modulus of 20 cN/dtex, an elastic recovery of 85%, and a U% of 1.0%.

In this regard, ηsp/c was determined in such a manner that the polymer is dissolved at 90° C. in o-chlorophenol to be a solution of a concentration of 1 g/dl, then is transferred to an Ostwald viscometer, in which the measurement is carried out at 35° C. ηsp/c was calculated by the following equation:

$$\eta sp/c=(T/T0-1)/C$$

wherein T is a dropping time (seconds) of the solution, T0 is a dropping time (seconds) of the solvent, and C is the concentration of solution (g/dl)

Fourteen lengths of the polytrimethylene terephthalate multifilamentary basic yarn of 235 dtex/35 f thus obtained were collected together to form a multifilamentary yarn of 3290 dtex/490 f. Five lengths of the multifilamentary yarn were further collected to form a yarn of 16450 dtex/2450 f. The resultant yarn was twisted at 70 T/m.

Then, the yarn was immersed into a liquid prepared from 100 parts of BURNOCK 16-416 (urethane type adhesive), 10 parts of BURNOCK DN-950 (crosslinker), 1 part of CRISVON Accel T (crosslinking accelerator) (all produced by DAINIPPON INK K.K.) and 50 parts of toluene, squeezed through a mangle and, after being dried, subjected to a constant-length heat treatment at 170° C. for 1 minute. Thereafter, it was coated with molten nylon 6 resin to result in a racket string. The string thus obtained had a strength at break of 578 N, an elongation of 32%, a stress-retaining ratio at 49.0 N of 84%, a stress-retaining ratio at 205.9 N of 85%, an elastic recovery of 80% and a residual elongation of 4.8%.

The performance of the string and the result of the feeling test are shown in Table 1.

The string of the present invention is excellent in homogeneity and high in mechanical strength, and exhibits durable resilience and impact resistance in the feeling test.

EXAMPLE 2

An undrawn yarn was obtained from polytrimethylene terephthalate chips having ηsp/c of 1.1 at a spinning temperature of 260° C. and a spinning speed of 1100 m/min, and drawn at a hot roll temperature of 60° C. and a hot plate temperature of 140° C., a draw ratio of 2.5 times and a drawing speed of 600 m/min to result in a drawn yarn of 330 dtex/6 f. Physical properties of the drawn yarn were a strength of 3.5 cN/dtex, an elongation of 39%, an elastic modulus of 21 cN/dtex, an elastic recovery of 77%, and a U% of 2.1%.

Thirteen lengths of the polytrimethylene terephthalate multifilamentary basic yarn of 330 dtex/6 f thus obtained were collected together to form a multifilamentary basic yarn of 4290 dtex/78 f. Five lengths of the multifilamentary yarn were further collected using a creel while being twisted at 70 T/m, to result in a yarn of 21450 dtex/390 f. Then, the yarn was immersed into a liquid prepared from 100 parts of ACRYDIC A-190 (urethane type adhesive), 10 parts of TYFORCE AG-940 HV (crosslinker), (all produced by DAINIPPON INK K.K.) and 50 parts of toluene, squeezed through a mangle and after being dried, subjected to a constant-length heat treatment at 170° C. for 1 minute. Thereafter, it was coated with molten polytrimethylene terephthalate resin to result in a racket string. The string thus obtained had a strength at break of 710 N, an elongation of 36%, a stress-retaining ratio at 49.0 N of 75%, a stress-retaining ratio at 205.9 N of 75%, an elastic recovery of 73% and a residual elongation of 5.5%.

The performance of the string and the result of the feeling test are shown in Table 1.

The string of the present invention is excellent in homogeneity and high in mechanical strength, and exhibits good resilience and impact resistance in the feeling test.

EXAMPLE 3

In the same manner as in Example 2, a drawn yarn of 220 dtex/10 f was obtained. The raw yarn thus obtained had a strength of 3.6 cN/dtex, an elongation of 38%, an elastic modulus of 20 cN/dtex, an elastic recovery of 84% and a U% of 1.8%.

Eleven lengths of the polytrimethylene terephthalate multifilamentary basic yarn of 220 dtex/10 f were collected together to form a multifilamentary yarn of 2420 dtex/110 f. Three lengths of the multifilamentary yarn were further collected and twisted at 100 T/m, to result in a yarn of 72600 dtex/330 f. Then, the yarn was immersed into a liquid prepared from 100 parts of BURNOCK 16-416 (urethane type adhesive), 10 parts of BURNOCK DN-950 (crosslinker), 1 part of CRISVON Accel T (crosslinking accelerator) (all produced by DAINIPPON INK K.K.) and 50 parts of toluene, squeezed through a mangle and after being dried, subjected to a 5%-elongated heat treatment at 170° C. for one minute. Thereafter, it was coated with molten nylon 6 resin to result in a racket string. The string thus obtained had a strength at break of 260 N, an elongation of 34%, a stress-retaining ratio at 49.0 N of 79%, a stress-retaining ratio at 205.9 N of 80%, an elastic recovery of 80% and a residual elongation of 3.2%.

The performance of the string and the result of the feeling test are listed in Table 1.

The string of the present invention is excellent in homogeneity, and exhibits good resilience and impact resistance in the feeling test.

EXAMPLE 4

In the same manner as in Example 1, a drawn yarn of 84 dtex/75 f was obtained. The raw yarn thus obtained had a strength of 3.7 cN/dtex, an elongation of 35%, a elastic modulus of 21 cN/dtex, an elastic recovery of 87% and a U% of 1.2%.

Twenty lengths of the polytrimethylene terephthalate multifilamentary basic yarn of 84 dtex/75 f were collected together to form a multifilamentary yarn of 1680 dtex/1500 f. Eleven lengths of the multifilamentary yarn were further collected and twisted together at 100 T/m, to result in a yarn of 18480 dtex/16500 f. Then, the yarn was immersed into a liquid prepared from 100 parts of BURNOCK DF-407 (urethane type adhesive), 10 parts of BURNOCK DN-950 (crosslinker), 1 part of CRISVON Accel T (crosslinking accelerator) (all produced by DAINIPPON INK K.K.) and 50 parts of toluene, squeezed through a mangle and after being dried, subjected to a 3%-elongated heat treatment at 170° C. for one minute. Thereafter, it was coated with molten polytrimethylene terephthalate resin to result in a racket string. The string thus obtained had a strength at break of 640 N, an elongation of 33%, a stress-retaining ratio at 49.0 N of 83%, a stress-retaining ratio at 205.9 N of 83%, an elastic recovery of 84% and a residual elongation of 4.3%.

The performance of the string and the result of the feeling test are listed in Table 1.

The string of the present invention is excellent in homogeneity, and exhibits good resilience and impact resistance in the feeling test as well as has a good durability.

EXAMPLE 5

An undrawn yarn was obtained from polytrimethylene terephthalate chips having ηsp/c of 1.0 at a spinning temperature of 265° C. and a spinning speed of 1100 m/min, and drawn at a hot roll temperature of 60° C. and a hot plate temperature of 140° C., a draw ratio of 2.5 times and a drawing speed of 700 m/min to result in a drawn yarn of 250 dtex/23 f. Physical properties of the drawn yarn were a strength of 3.3 cN/dtex, an elongation of 36%, an elastic modulus of 22 cN/dtex, an elastic recovery of 87%, and a U% of 1.3%.

Nine lengths of the polytrimethylene terephthalate multifilamentary basic yarn of 250 dtex/23 f thus obtained were collected together to form a multifilamentary yarn of 2250 dtex/207 f. Four lengths of the multifilamentary yarn were further collected using a creel while being twisted at 90 T/m, to result in a yarn of 9000 dtex/828 f. Another yarn obtained by collecting twelve lengths of nylon 66 yarns of 470 dtex/14 f (produced by ASAHI KASEI KOGYO K.K.) was immersed into a liquid prepared from 100 parts of BURNOCK 16-416 (urethane type adhesive), 10 parts of BURNOCK DN-950 (crosslinker), 1 part of CRISVON Accel T (crosslinking accelerator) (all produced by DAINIPPON INK K.K.) and 50 parts of toluene and squeezed through a mangle. Both the yarns were together passed through a covering process while using the former as a core component and the latter as a sheath component at a ratio of 100 T/m to form a covered yarn which then was dried and subjected to a constant-length heat treatment at 170° C. for 1 minute. Thereafter, it was coated with molten nylon 6 resin to result in a racket string. The string thus obtained had a strength at break of 610 N, an elongation of 33%, a stress-retaining ratio at 49.0 N of 85%, a stress-retaining ratio at 205.9 N of 84%, an elastic recovery of 78% and a residual elongation of 3.6%.

The performance of the string and the result of the feeling test were shown in Table 1.

The string of the present invention is excellent in homogeneity and high in mechanical strength, and exhibits durable resilience and impact resistance in the feeling test.

EXAMPLE 6

Twenty nine lengths of the polytrimethylene terephthalate multifilamentary basic yarn of 235 dtex/35 f obtained in Example 1 were collected together to form a multifilamentary yarn of 6815 dtex/1015 f.

From this yarn, a racket string was manufactured in the same manner as in Example 1. The string thus obtained had a strength at break of 225 N, an elongation of 33%, a stress-retaining ratio at 49.0 N of 79%, a stress-retaining ratio at 205.9 N of 78% and an elastic recovery of 80%. A residual elongation could not be measured because of yarn breakage.

COMPARATIVE EXAMPLE 1

In the same manner as in Example 1, a drawn yarn of 84 dtex/105 f was obtained. Physical properties of the drawn yarn were a strength of 3.0 cN/dtex, an elongation of 35%, an elastic modulus of 22 cN/dtex, an elastic recovery of 86%, and a U% of 3.2%. This yarn was poor in homogeneity.

Twenty lengths of the polytrimethylene terephthalate multifilamentary basic yarn of 84 dtex/105 f thus obtained were collected together to form a multifilamentary yarn of 1680 dtex/2100 f. Eleven lengths of the multifilamentary yarn were further collected together and twisted at 100 T/m, to result in a yarn of 18480 dtex/23100 f.

From this yarn, a racket string was manufactured in the same manner as in Example 5. The string thus obtained had a strength at break of 525 N, an elongation of 34%, a stress-retaining ratio at 49.0 N of 83%, a stress-retaining ratio at 205.9 N of 81%, an elastic recovery of 83% and a residual elongation of 4.5%.

The performance of the string and the result of the feeling test are listed in Table 1.

The string of Comparative example 1 was somewhat poor in homogeneity, and exhibited good resilience and impact resistance in the feeling test. However, it was broken at an early stage and poor in durability.

COMPARATIVE EXAMPLE 2

In the same manner as in Example 2, a drawn yarn of 280 dtex/4 f was obtained. Physical properties of the drawn yarn were a strength of 2.7 cN/dtex, an elongation of 39%, an elastic modulus of 21 cN/dtex, an elastic recovery of 70%, and a U% of 3.6%. This yarn was poor in homogeneity.

Fourteen lengths of the polytrimethylene terephthalate multifilamentary basic yarn of 280 dtex/4 f thus obtained were collected together to form a multifilamentary yarn of 3920 dtex/56 f. Five lengths of the multifilamentary yarn were further collected using a creel while being twisted at 70 T/m to result in a yarn of 19600 dtex/280 f.

From this yarn, a racket string was manufactured in the same manner as in Example 2. The string thus obtained had a strength at break of 501 N, an elongation of 37%, a stress-retaining ratio at 49.0 N of 65%, a stress-retaining ratio at 205.9 N of 66%, an elastic recovery of 65% and a residual elongation of 5.8%.

The performance of the string and the result of the feeling test are shown in Table 1.

The string of Comparative example 2 was a little poor in homogeneity and was poor both in resilience and impact resistance in the feeling test.

COMPARATIVE EXAMPLE 3

A racket string was manufactured in the same manner as in Comparative example 2, except that the constant-length heat treatment is replaced with a 5%-relaxed heat treatment.

The string thus obtained had a strength at break of 498 N, an elongation of 41%, a stress-retaining ratio at 49.0 N of 62%, a stress-retaining ratio at 205.9 N of 61%, an elastic recovery of 58% and a residual elongation of 9.6%.

The performance of the string and the result of the feeling test are shown in Table 1.

The string of Comparative example 3 was somewhat poor in homogeneity and also poor both in resilience and impact resistance in the feeling test.

COMPARATIVE EXAMPLE 4

Twenty eight lengths of the polytrimethylene terephthalate multifilamentary basic yarn of 220 dtex/10 f obtained in Example 3 were collected together to form in a multifilamentary yarn of 6160 dtex/280 f. Further, four lengths of this multifilamentary yarn were collected and twisted together at 70 T/m to result in a yarn of 24640 dtex/1120 f.

From this yarn, a racket string was manufactured in the same manner as in Example 3. The string thus obtained had a strength at break of 840 N, an elongation of 35%, a stress-retaining ratio at 49.0 N of 78%, a stress-retaining ratio at 205.9 N of 78%, an elastic recovery of 79% and a residual elongation of 6.8%.

The performance of the string and the result of the feeling test were shown in Table 1.

The string of Comparative example 4 was poor both in resilience and impact resistance in the feeling test.

COMPARATIVE EXAMPLE 5

The same polytrimethylene terephthalate chips as used in Example 1 were melted at 260° C. and spun as a monofilamentary yarn, which was once cooled through a water bath at 15° C., then passed through a hot water bath at 70° C., drawn, relaxed, heat-set through two heaters disposed respectively between three rolls, and taken up. Peripheral speeds of the three rolls were 10.5 m/min, 42.3 m/min and 42.3 m/min in the order closer to the spinning orifice, and the temperatures of the two heaters were 70° C. and 100° C. in the order closer to the spinning orifice. The monofilament thus obtained had a size of 660 dtex. Physical properties of the monofilament thus obtained were a strength of 2.6 cN/dtex, an elongation of 45%, an elastic modulus of 22 cN/dtex, an elastic recovery of 65%, and a U% of 3.5%.

Twenty five lengths of this monofilament were collected and twisted together at 100 T/m to form a monofilamentary yarn of 16500 dtex.

From this yarn, a racket string was manufactured in the same manner as in Example 3. The string thus obtained had a strength at break of 402 N, an elongation of 40%, a stress-retaining ratio at 49.0 N of 65%, a stress-retaining ratio at 205.9 N of 64%, an elastic recovery of 60% and a residual elongation of 7.6%.

The performance of the string and the result of the feeling test are shown in Table 1.

multifilamentary yarn had a strength of 4.1 cN/dtex, an elongation of 33%, an elastic modulus of 97 cN/dtex, a U% of 1.5% and an elastic recovery of 25%. The string thus obtained had a strength at break of 638 N, an elongation of 31%, a stress-retaining ratio at 49.0 N of 57%, at 205.9 N of 55%, an elastic recovery of 24% and a residual elongation of 1.2%.

The performance of the string and the result of the feeling test are shown in Table 1.

The string obtained from Comparative example was poor both in resilience and impact resistance.

TABLE 1

| | Strength at break N / elongation at break % | Stress-retaining ratio % at 49.0 N / at 205.9 N | Elastic recovery % | Residual elongation % | Feeling test one day after: resilience | Feeling test one day after: impact resistance | Feeling test twenty days after: resilience | Feeling test twenty days after: impact resistance | Durability: breakage of string |
|---|---|---|---|---|---|---|---|---|---|
| Ex. 1 | 578/32 | 84/85 | 80 | 4.8 | ◎ | ◎ | ◎ | ◎ | 1130 |
| Ex. 2 | 710/36 | 75/75 | 73 | 5.5 | ○ | ○ | ○ | ○ | 1207 |
| Ex. 3 | 260/34 | 79/80 | 80 | 3.2 | ◎ | ○ | ◎ | ○ | 890 |
| Ex. 4 | 640/33 | 83/83 | 84 | 4.3 | ◎ | ◎ | ◎ | ◎ | 1121 |
| Ex. 5 | 610/33 | 85/84 | 78 | 3.6 | ○ | ◎ | ○ | ◎ | 1306 |
| Ex. 6 | 225/33 | 79/78 | 80 | broken | — | — | — | — | — |
| Com. 1 | 525/34 | 83/81 | 83 | 4.5 | ◎ | ◎ | ◎ | ◎ | 504 |
| Com. 2 | 501/37 | 65/66 | 65 | 5.8 | Δ | Δ | Δ | Δ | 1208 |
| Com. 3 | 498/41 | 62/61 | 58 | 9.6 | x | Δ | x | Δ | 1300 |
| Com. 4 | 840/35 | 78/78 | 79 | 6.8 | x | Δ | x | Δ | 1350 |
| Com. 5 | 402/40 | 65/64 | 60 | 7.6 | x | ○ | x | ○ | 964 |
| Com. 6 | 843/27 | 68/66 | 62 | 1.9 | Δ | Δ | Δ | Δ | 1380 |
| Com. 7 | 638/31 | 57/55 | 24 | 1.2 | Δ | x | x | Δ | 1150 |

The string was poor in resilience and in the feeling test.

COMPARATIVE EXAMPLE 6

Seventeen lengths of nylon 66 multifilamentary basic yarn of 940 dtex/140 f (Leona; produced by ASAHI KASEI KOGYO K.K.; having a strength of 6.2 cN/dtex, an elongation of 28%, an elastic modulus of 65 cN/dtex and an elastic recovery of 65%) were collected and twisted together at 70 T/m to form a multifilamentary yarn of 14280 dtex/2380 f.

A racket string was manufactured from the resultant yarn in the same manner as in Example 1. The string thus obtained had a strength at break of 843 N, an elongation of 27%, a stress-retaining ratio at 49.0 N of 68%, a stress-retaining ratio at 205.9 N of 66%, an elastic recovery of 62% and a residual elongation of 1.9%.

The performance of the string and the result of the feeling test are shown in Table 1.

While the string was excellent in homogeneity, the resilience lowered with time from a favorable level of the initial stage. Also the impact resistance was not so good. Under high humidity conditions, the lowering was significant.

COMPARATIVE EXAMPLE 7

A racket string was manufactured in the same manner as in Example 1, except that polyethylene terephthalate multifilamentary yarn of 235 dtex/35 f (produced by ASAHI KASEI KOGYO K.K.) was used in place of the polytrimethylene terephthalate multifilamentary basic yarn of 235 dtex/35 f. In this regard, the polyethylene terephthalate

COMPARATIVE EXAMPLE 8

The racket string obtained from Example 6 caused filament breakage during the setting thereof under tension across a racket frame due to a lack of strength, and was unsuitable for this purpose.

EXAMPLE 7

Ten lengths of the polytrimethylene terephthalate multifilamentary basic yarn of 220 dtex/10 f obtained from Example 3 were collected together and subjected to a constant-length heat treatment at 170° C. for one minute to result in a multifilamentary yarn of 2200 dtex/100 f. The yarn thus obtained had a tensile strength of 79N, an elongation of 38%, a stress-retaining ratio at 49.0 N of 78% and an elastic recovery of 84%.

A steel piano wire of 0.16 mm thick was twined around the multifilamentary yarn in a spiral form to obtain a fourth string for a guitar.

The estimated results of variation in tuning (condition 1), tunability, durability and easiness to play of the string thus obtained were shown in Table 2.

The string of the present invention had the stability in tuning over time and with a change in humidity, and the string was excellent in tunability and durability as well as easy to play.

EXAMPLE 8

An undrawn yarn was obtained from polytrimethylene terephthalate chips having ηsp/c of 1.0 at a spinning temperature of 265° C. and a spinning speed of 1200 m/min, and drawn at a hot roll temperature of 60° C. and a hot plate temperature of 140° C., a draw ratio of 3 times and a drawing speed of 800 m/min to result in a drawn yarn of 220 dtex/200 f. The drawn yarn had a strength of 3.5 cN/dtex, an elongation of 36%, an elastic modulus of 21 cN/dtex, a U% of 1.6% and an elastic recovery of 86%.

Ten lengths of the polytrimethylene terephthalate multifilamentary basic yarn thus obtained were collected together and subjected to a constant-length heat treatment at 170° C. for 1 minute to form a multifilamentary yarn of 2200 dtex/2000 f. The resultant yarn had a tensile strength of 77 N, an elongation of 36%, a stress-retaining ratio at 49.0 N of 80% and an elastic recovery of 85%.

A steel piano wire of 0.16 mm thick was twined around the multifilamentary yarn in a spiral form to obtain a fourth string for a guitar.

The estimated results of variation in tuning (condition 1), tunability, durability and easiness to play of the string thus obtained are shown in Table 2.

The string of the present invention had the stability in tuning over time and with a change in humidity, and the string was excellent in tunability and durability as well as easy to play.

EXAMPLE 9

Seven lengths of the polytrimethylene terephthalate multifilamentary basic yarn of 330 dtex/6 f obtained from Example 2 were collected together and subjected a constant-length heat treatment at 170° C. for 1 minute to result in a multifilamentary yarn of 2310 dtex/42 f. The yarn thus obtained had a tensile strength of 82 N, an elongation of 38%, a stress-retaining ratio at 49.0 N of 75% and an elastic recovery of 77%.

A steel piano wire of 0.16 mm was twined around this multifilamentary yarn in a spiral form to obtain a fourth string for a guitar.

The estimated results of variation in tuning (condition 1), tunability, durability and easiness to play of the string thus obtained are shown in Table 2.

The string of the present invention had the stability in tuning over time and with a change in humidity, and the string was excellent in tunability and durability as well as easy to play.

EXAMPLE 10

Ten lengths of the polytrimethylene terephthalate multifilamentary basic yarn of 220 dtex/10 f obtained from Example 3 were collected together to result in a multifilamentary yarn of 2200 dtex/100 f. Then, three lengths of this yarn were immersed into a liquid prepared from 100 parts of BURNOCK 16-416 (urethane type adhesive), 10 parts of BURNOCK DN-950 (crosslinker), 1 part of CRISVON Accel T (crosslinking accelerator) (all produced by DAINIPPON INK K.K.) and 50 parts of toluene, squeezed through a mangle, twisted at 100 T/m, dried, and subjected to a constant-length heat treatment at 170° C. for 1 minute.

Thereafter, molten polytrimethylene terephthalate resin was coated on the outer surface thereof to obtain a yarn of 6600 dtex/ 300 f, from which a second string for a guitar was formed. This yarn (string) had a tensile strength of 223 N, an elongation of 35%, a stress-retaining ratio at 49.0 N of 78% and an elastic recovery of 80%.

The estimated results of variation in tuning (condition 3), tunability, durability and ease of play of the string thus obtained are shown in Table 2.

The string of the present invention had the stability in tuning over time, and the string was excellent in tunability and durability as well as easy to play.

EXAMPLE 11

An undrawn yarn was obtained from polytrimethylene terephthalate chips having ηsp/c of 1.1 at a spinning temperature of 265° C. and a spinning speed of 1200 m/min, and drawn at a hot roll temperature of 60° C. and a hot plate temperature of 140° C., a draw ratio of 3 times and a drawing speed of 800 m/min to result in a drawn yarn of 280 dtex/10 f. The drawn yarn had a strength of 3.4 cN/dtex, an elongation of 38%, an elastic modulus of 20 cN/dtex, a U% of 1.8% and an elastic recovery of 84%.

Five lengths of the polytrimethylene terephthalate multifilamentary basic yarn thus obtained were collected together to form a multifilamentary yarn of 1400 dtex/50 f. Then, ten lengths of this yarn were immersed into a liquid prepared from 100 parts of BURNOCK 16-411(urethane type adhesive), 10 parts of BURNOCK DN-950 (crosslinker), 1 part of CRISVON Accel T (crosslinking accelerator) (all produced by DAINIPPON INK K.K.) and 50 parts of toluene, squeezed through a mangle, twisted at 100 T/m, dried, and subjected to a constant-length heat treatment at 170° C. for 1 minute. Thereafter, molten nylon 6 resin was coated on the outer surface thereof to form a yarn of 4000 dtex/500 f, from which was obtained a third string for a guitar. The yarn (string) thus obtained had a tensile strength of 466 N, an elongation of 37%, a stress-retaining ratio at 49.0 N of 75% and an elastic recovery of 79%.

The estimated results of variation in tuning (condition 2), tunability, durability and easiness to play of the string thus obtained are shown in Table 2.

The string of the present invention had the stability in tuning over time and the string was excellent in tunability and durability as well as easy to play.

EXAMPLE 12

Ten lengths of the polytrimethylene terephthalate multifilamentary basic yarn of 220 dtex/10 f obtained from Example 3 were collected and twisted together at 100 T/m to obtain a multifilamentary core yarn of 2200 dtex/100 f. Two lengths of nylon 66 multifilament basic yarn of 220 dtex/10 f (produced by ASAHI KASEI KOGYO K.K.) were spirally twined as a sheath component around the core component. Both the components were immersed into a liquid prepared from 100 parts of TYFORCE AG-949 HV (urethane type adhesive), 10 parts of BURNOCK DN-950 (crosslinker), one part of CRISVON Accel T (crosslinking accelerator) (all produced by DAINIPPON INK K.K.) and 50 parts of toluene, squeezed through a mangle, twisted at 100 T/m, dried and subjected to a constant-length heat treatment at 170° C. for one minute to obtain a composite yarn of 2640 dtex/120 f.

The composite yarn thus obtained had a tensile strength of 95 N, an elongation of 36%, a stress-retaining ratio at 49.0 N of 78%, and an elastic recovery of 79%. A steel piano wire of 0.16 mm was twined around this yarn in a spiral form to result in a fourth string for a guitar.

The estimated results of variation in tuning (condition 1), tunability, durability and ease of play of the string thus obtained are shown in Table 2.

The string of the present invention had the stability in tuning over time and with a change of humidity and the string was excellent in tunability and durability as well as easy to play.

EXAMPLE 13

Ten lengths of the polytrimethylene terephthalate multifilamentary basic yarn of 220 dtex/10 f obtained from Example 3 were collected and twisted together to obtain a multifilamentary yarn of 2200 dtex/100 f. This yarn was high in strength, elastic recovery and stress-retaining ratio as well as excellent in water resistance, softness and homogeneity of yarn properties.

Then, seven lengths of this yarn were collected together, immersed into a liquid prepared from 50 parts of BURNOCK DF-407 (urethane type adhesive), 10 parts of BURNOCK DN-950 (crosslinker), 1 part of CRISVON Accel T (crosslinking accelerator) (all produced by DAINIPPON INK K.K.) and 100 parts of toluene, squeezed through a mangle, twisted at 100 T/m, dried, and subjected to a constant-length heat treatment at 170° C. for 1 minute. Thereafter, molten nylon 6 resin was coated on the outer surface of the yarn to result in a yarn of 15400 dtex/700 f, from which a third string for a guitar was prepared.

The string thus obtained had a tensile strength of 537 N, an elongation of 39%, a stress-retaining ratio at 49.0 N of 77%, and an elastic recovery of 83%.

The estimated results of variation in tuning (condition 2), tunability, durability and easiness to play of the string thus obtained are shown in Table 2.

According to the string of the present invention, while the stability in tuning over time was good, the guitar was difficult to play because the string was too thick.

COMPARATIVE EXAMPLE 9

A fourth string for a guitar was obtained in the same manner as in Example 7, except that the nylon 66 multifilamentary yarn of 220 dtex/10 f used in Example 12 was used instead of the polytrimethylene terephthalate multifilamentary yarn of 220 dtex/10 f. The nylon 66 multifilamentary yarn had a strength of 4.3 cN/dtex, an elongation of 32%, a modulus of elasticity of 31 cN/dtex, a U% of 2.1% and an elastic recovery of 65%, and the resultant yarn of 2200 dtex/100 f had a tensile strength of 94 N, an elongation of 33%, a stress-retaining ratio at 49.0 N of 65% and an elastic recovery of 65%.

The estimated results of variation in tuning (condition 1), tunability, durability and easiness to play of the string thus obtained were shown in Table 2.

The string of Comparative example 9 had hardly the stability in tuning over time and with a change in humidity and the string was poor in tunability

COMPARATIVE EXAMPLE 10

A fourth string for a guitar was obtained in the same manner as in Example 7, except that polyethylene terephthalate multifilamentary yarn of 220 dtex/10 f (produced by ASAHI KASEI KOGYO K.K) was used instead of the polytrimethylene terephthalate multifilamentary yarn of 220 dtex/10 f. The polyethylene terephthalate multifilamentary yarn had a strength of 4.0 N, an elongation of 34%, an elastic modulus of 97 cN/dtex, a U% of 1.5% and an elastic recovery of 25%, and the resultant yarn of 2200 dtex/100 f had a tensile strength of 88 N, an elongation of 34%, a stress-retaining ratio at 49.0 N of 49% and an elastic recovery of 24%.

The estimated results of variation in tuning (condition 1), tunability, durability and easiness to play of the string thus obtained are shown in Table 2.

The string of Comparative example 10 had hardly the stability in tuning over time and the string was poor in tunability.

COMPARATIVE EXAMPLE 11

In the same manner as in Comparative example 1, a drawn yarn of 84 dtex/105 f was obtained. Physical properties of the yarn thus obtained were in that a strength is 3.2 cN/dtex, an elongation is 35%, an elastic modulus is 22 cN/dtex, an elastic recovery is 86% and a U% is 3.2%, which means that the homogeneity of the yarn was poor.

Twenty five lengths of this polytrimethylene terephthalate multifilamentary basic yarns thus obtained were collected together to form a multifilamentary yarn of 2100 dtex/2625 f. The yarn thus obtained had a tensile strength of 67 N, an elongation of 34%, a stress-retaining ratio at 49.0 N of 80% and an elastic recovery of 86%. A steel piano wire of 0.16 mm thick was wound around this yarn in a spiral form to result in a fourth string for a guitar.

The estimated results of variation in tuning (condition 1), tunability, durability and ease of play of the string thus obtained are shown in Table 2.

The string of Comparative example 11 had the stability in tuning over time and with a change in humidity, but the string was poor in durability.

COMPARATIVE EXAMPLE 12

An undrawn yarn was obtained from polytrimethylene terephthalate chips having ηsp/c of 1.0 at a spinning temperature of 265° C. and a spinning speed of 1000 m/min, and drawn at a hot roll temperature of 60° C. and a hot plate temperature of 140° C., a draw ratio of 3 times and a drawing speed of 600 m/min to result in a drawn yarn of 235 dtex/3 f. Physical properties of the drawn yarn were a strength of 3.1 cN/dtex, an elongation of 40%, an elastic modulus of 20 cN/dtex, a U% of 3.5%, and an elastic recovery of 64%, but the yarn was poor in homogeneity.

Ten lengths of the polytrimethylene terephthalate multifilamentary basic yarn of 235 dtex/3 f thus obtained were collected together and subjected to a constant-length heat treatment at 170° C. for one minute to form a multifilamentary yarn of 2350 dtex/30 f. The yarn thus obtained had a tensile strength 72 N, an elongation of 40%, a stress-retaining ratio at 49.0 N of 64% and an elastic recovery of 61%.

A steel piano wire of 0.16 mm thick was wound around this multifilamentary yarn in a spiral form to result in a fourth string for a guitar.

The estimated results of variation in tuning (condition 1), tunability, durability and ease of play of the string thus obtained are shown in Table 2.

The string of Comparative example 12 had hardly the stability in tuning over time and the string was poor in tunability.

COMPARATIVE EXAMPLE 13

In the same manner as in Comparative example 12, except that the constant-length heat treatment is replaced with a 5%-relaxed heat treatment, a multifilamentary yarn of 2350 dtex/30 f was obtained. The yarn thus obtained had a tensile strength of 70 N, an elongation of 44%, a stress-retaining ratio at 49.0 N of 60% and an elastic recovery of 57%.

A steel piano wire of 0.16 mm thick was wound around this multifilamentary yarn in a spiral form to result in a fourth string for a guitar.

The estimated results of variation in tuning (condition 1), tunability, durability and easiness to play of the string thus obtained are shown in Table 2.

The string of Comparative example 13 had hardly the stability in tuning over time and the string was poor in tunability.

The estimated results of variation in tuning (condition 3), tunability, durability and easiness to play of the string thus obtained are shown in Table 2.

The string of Comparative example 15 had hardly the stability in tuning over time and the string was poor in tunability.

TABLE 2

| | Elastic recovery % | Stress-retaining ratio % at 49.0 N | Variation in tuning (Hz) set frequency | measured frequency | decision | Tunability | Durability | Ease of play |
|---|---|---|---|---|---|---|---|---|
| Ex. 7 | 84 | 78 | 587 | 583 | ○ | ◎ | ◎ | ◎ |
| Ex. 8 | 85 | 80 | 587 | 585 | ○ | ◎ | ○ | ◎ |
| Ex. 9 | 77 | 75 | 587 | 580 | ○ | ○ | ◎ | ◎ |
| Ex. 10 | 80 | 78 | 986 | 984 | ○ | ◎ | ◎ | ○ |
| Ex. 11 | 79 | 75 | 784 | 782 | ○ | ○ | ◎ | ○ |
| Ex. 12 | 79 | 78 | 587 | 579 | ○ | ○ | ◎ | ◎ |
| Ex. 13 | 83 | 77 | 784 | 780 | ○ | ○ | ◎ | x |
| Com. 9 | 65 | 65 | 587 | 493 | x | Δ | ○ | ○ |
| Com. 10 | 24 | 49 | 587 | 523 | x | x | ○ | ○ |
| Com. 11 | 86 | 80 | 587 | 581 | ○ | ○ | x | ○ |
| Com. 12 | 61 | 64 | 587 | 554 | x | x | ◎ | ○ |
| Com. 13 | 57 | 60 | 587 | 543 | x | x | ◎ | ○ |
| Com. 14 | 84 | broken | broken | — | — | — | x | broken |
| Com. 15 | 60 | 58 | 986 | 952 | x | x | ○ | ○ |

COMPARATIVE EXAMPLE 14

Six lengths of the polytrimethylene terephthalate multifilamentary basic yarn of 220 dtex/10 f obtained from Example 3 were collected together and subjected to a constant-length heat treatment at 170° C. for one minute to result in a multifilamentary yarn of 1320 dtex/60 f. The yarn thus obtained had a tensile strength of 47 N, an elongation of 38% and an elastic recovery of 84%. That is, the tensile strength was excessively low. In this regard, a stress-retaining ratio at 49.0 N could not be measured due to yarn breakage.

A steel piano wire of 0.16 mm was wound around this multifilamentary yarn in a spiral form to result in a fourth string for a guitar.

The string thus obtained was improper for a fourth string for a guitar because it broke when set on a guitar under a proper tension as the fourth string.

COMPARATIVE EXAMPLE 15

The same polytrimethylene terephthalate chips as used in Example 1 were melted at 260° C. and spun as a monofilamentary yarn which then was once cooled through a water bath at 15° C., passed through a hot water bath at 70° C., drawn, relaxed and heat-set through two heaters disposed between three rolls, respectively, and finally taken up as a monofilament of 6600 dtex. Peripheral speeds of the three rolls were 8.5 m/min, 31.4 m/min and 31.4 m/min in the order closer to the spinning orifice, and the temperatures of the two heaters were 70° C. and 100° C. in the order closer to the spinning orifice. Physical properties of the monofilament thus obtained were a strength of 2.4 cN/dtex, an elongation of 48%, an elastic modulus of 20 cN/dtex, a stress-retaining ratio at 49.0 N of 58%, an elastic recovery of 60%, and a U% of 3.7%.

A second string for a guitar was prepared from this monofilament.

What is claimed is:

1. A yarn comprising polytrimethylene terephthalate multifilamentary fibers substantially without crimp having a single-fiber size in a range from 1 to 56 dtex, which are collected together to have a total size in a range from 2000 to 22000 dtex, said yarn having a stress-retaining ratio at a stress of 49.0 N of 70% or more and an elastic recovery of 70% or more.

2. A yarn as defined by claim 1, wherein a stress-retaining ratio at a stress of 49.0 N is 70% or more.

3. A yarn as defined by claim 1, wherein a stress-retaining ratio at a stress of 49.0 N is 70% or more and an elastic recovery is 70% or more.

4. A racket string comprising polytrimethylene terephthalate multifilamentary fibers without crimp having a single-fiber size in a range from 1 to 56 dtex, which are collected together to have a total size in a range from 7000 to 22000 dtex, said string having a stress-retaining ratio at a stress of 49.0 N of 70% or more and an elastic recovery of 70% or more.

5. A musical instrumental string comprising polytrimethylene terephthalate multifilamentary fibers having a single-fiber size in a range from 1 to 56 dtex, which are collected together to have a total size in a range from 2000 to 14000 dtex.

6. A musical instrumental string as defined by claim 5, wherein a stress-retaining ratio at a stress of 49.0 N is 70% or more.

7. A musical instrumental string as defined by claim 5, wherein a stress-retaining ratio at a stress of 49.0 N is 70% or more and an elastic recovery is 70% or more.

* * * * *

UNITED STATES PATENT AND TRADEMARK OFFICE

CERTIFICATE OF CORRECTION

PATENT NO. : 6,503,623 B1 
DATED : January 7, 2003
INVENTOR(S) : Kazuto Oue and Hiroshi Yamazaki It is certified that error appears in the above-identified patent and that said Letters Patent is hereby corrected as shown below:

Column 24,
Lines 38-42, delete claims 2 and 3 in their entirety and insert therefor:
-- 2. A process for producing a polytrimethylene terephthalate yarn composed of polytrimethylene terephthalate multifilamentary fibers substantially without crimp having a single-fiber size in a range from 1 to 56 dtex and total-fiber size in a range from 56 to 560 dtex comprising collecting together said fibers to have a total size in a range from 2000 to 22000 dtex, and then treating said yarn with heat at a temperature in a range from 150 to 200°C while said yarn is maintained at a constant length or in a stretched state.

3. A process for producing a polytrimethylene terephthalate yarn as defined by claim 2, where a stretching ratio during the heat treatment is in a range from 0 to 10%. --

Signed and Sealed this

Fifth Day of April, 2005

JON W. DUDAS
*Director of the United States Patent and Trademark Office*